United States Patent [19]

Way, Jr.

[11] 4,178,657

[45] Dec. 18, 1979

[54] SEPARABLE HINGE

[76] Inventor: Lee V. Way, Jr., Rte. 4, Box 185F, Sumter, S.C. 29150

[21] Appl. No.: 964,498

[22] Filed: Nov. 29, 1978

[51] Int. Cl.[2] ..... E05D 7/10

[52] U.S. Cl. ..... 16/173; 16/176

[58] Field of Search ..... 16/173, 171, 176, 183, 16/149, 166, 191, 168, 169, 181

[56] References Cited

U.S. PATENT DOCUMENTS

| | | | |
|---|---|---|---|
| 2,542,197 | 2/1951 | Hohlfeld | 16/147 |
| 3,671,998 | 6/1972 | Ruiz | 16/176 |
| 3,908,227 | 9/1975 | Cain | 16/137 |

*Primary Examiner*—George H. Krizmanich
*Attorney, Agent, or Firm*—B. B. Olive

[57] ABSTRACT

An easily and quickly separable hinge mechanism comprises a pair of hinge plates having spaced notched portions and spaced tubular portions which interfit to form a pivotal connector, a pair of hinge pins slidably located within the tubular portions, and a lever operated pin actuating mechanism. Movement of the pin actuating mechanism in one direction effects a uniting of the hinge members and movement of the pin actuating mechanism in the opposite direction effects a disengagement of the hinge parts so that they may be separated.

4 Claims, 21 Drawing Figures

SEPARABLE HINGE

BACKGROUND OF THE INVENTION

1. Field of the Invention

This invention relates generally to hinges and, more specifically, to hinges that facilitate easy, simple, and quick connection and disconnection of the hinged portions.

2. Description of the Prior Art

In the conventional hinge connection between two members, it is necessary to move the hinge pin its entire length before the hinge plates become disengaged. Oftentimes, this movement of the hinge pin is complicated where the hinge has been painted or there is a tight fit between the hinge and hinge pin. Most of the time, hand tools, e.g., hammer or screwdriver, will be needed to effect the removal of the pin.

With these problems in mind, various attempts have been made to provide quickly releasable hinge mechanism which are practical and inexpensive to manufacture.

U.S. Pat. Nos. 1,425,995; 2,368,899; 2,542,197; and 2,926,382 exemplify the state of the art. However, it is apparent that none of the devices described in such patents have satisfied the need for a simple, quickly detachable hinge because so far as is known, no such hinge is available or sold in the market.

SUMMARY OF THE INVENTION

A separable hinge structure according to the present invention utilizes a pair of hinge plates which have mating notched portions and tubular portions which interfit once properly aligned. A pair of hinge pins are slidably received in the recess enclosed by the interfitted tubular portions and are designed to slide therein for a predetermined distance. Each of the hinge pins has an integral extension rod extending outwardly from the recess through slots provided in the tubular portions. These extension rods connect to an appropriate lever operated pin actuating mechanism and upon movement by this actuating mechanism, cause the pins to move inwardly for the releasing operation and outwardly for the securing operation.

DESCRIPTION OF THE PREFERRED EMBODIMENT

Figure 1:
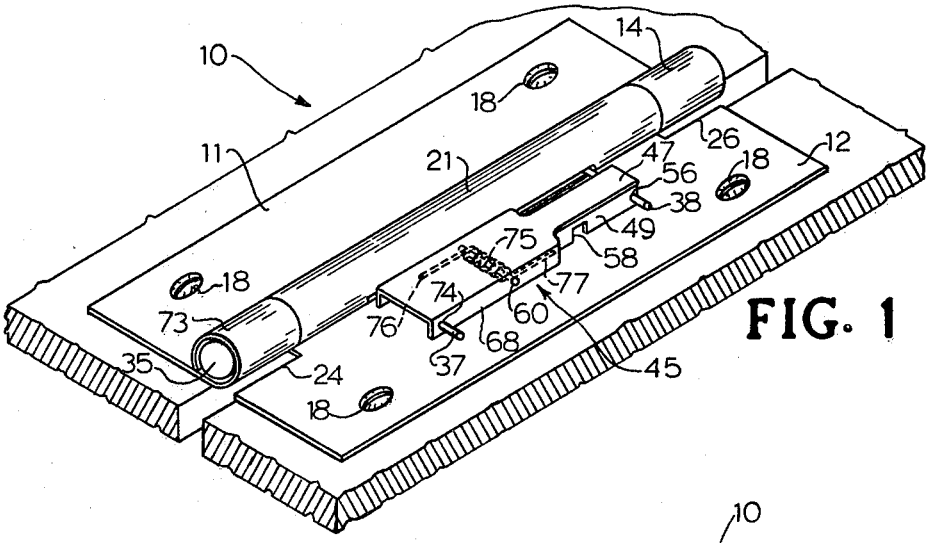
FIG. 1 is a perspective view of the separable hinge of the present invention with the hinge in an assembled relationship and as it would appear mounted on a surface.

Referring to the drawings, separable hinge 10 has a pair of hinge plates 11, 12. Hinge plate 11 comprises an elongated, flat, thin, metal plate having a pair of integral tubular end portions 13, 14 separated by a notched portion 17. Appropriate screw holes 15, 16 are punched into place 11 during the initial forming process.

Figure 11:
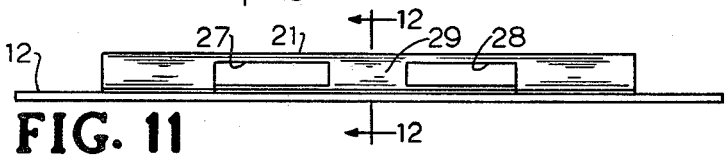
FIG. 11 is a front elevation view of the second hinge plate.
Figure 12:
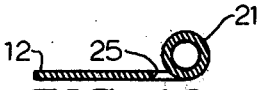
FIG. 12 is a section view taken substantially along line 12—12 of FIG. 11.
Figure 13:
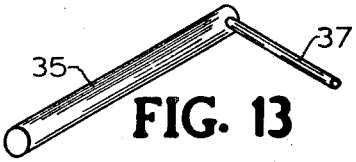
FIG. 13 is a perspective view of one of the hinge pins.
Figure 14:
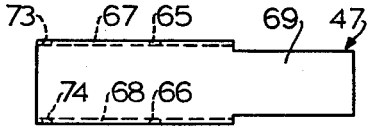
FIG. 14 is a plan view of the finger activating lever.
Figure 15:
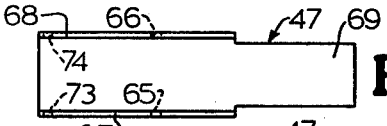
FIG. 15 is a bottom plan view of the lever shown in FIG. 14.
Figure 16:
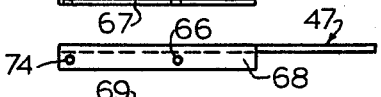
FIG. 16 is a front side elevation view of the lever shown in FIG. 14.
Figure 17:
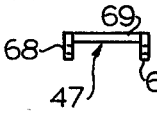
FIG. 17 is a front end view of the lever shown in FIG. 14.
Figure 18:
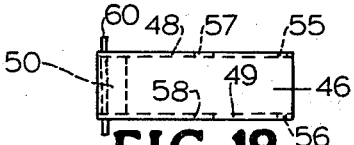
FIG. 18 is a top plan view of the interconnecting link member used with the lever of FIG. 14.
Figure 19:
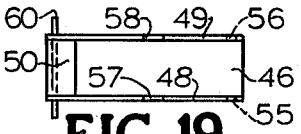
FIG. 19 is a bottom plan view of the link member.
Figure 20:
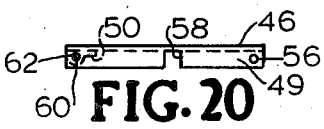
FIG. 20 is a side, elevation view of the link member.

Hinge plate 12 comprises an elongated, flat, thin metal plate having an integral tubular portion 21 provided centrally and on one side of plate 12 between notched portions 24, 26 and with appropriate screw holes 22, 23 for receiving screws 18. Of course, bolts, welding or other means of securement could be employed. Plate 11 also includes a central, elongated notch 17 as illustrated. Tubular portion 21 has a pair of slots 27, 28 formed therein with a divider 29 therebetween as best seen in FIG. 11 which separates the slots. Tubular portion 21 of plate 12 fits in notch 17 of plate 11.

A pair of hinge pins 35, 36 are adapted to reside and slide within tubular portion 21. Hinge pins 35, 36 have outwardly extending rods 37, 38 respectively, which are integrally secured to the respective pins adjacent their innermost ends and extend through and slide in slots 27, 28, respectively. Pins 35, 36 abut against divider 29 when at their innermost position and when at their outermost position they abut against the wall structure of tubular portion 21. Pins 35, 36 are thus free to slidably travel back and forth within tubular portion 21 with rods 37, 38 and with their travel being limited in the manner described.

Referring now to the lever operated pin actuating mechanism which is collectivly labeled 45, actuating mechanism 45 comprises a middle interconnecting actuating member or link 46 and a finger activating lever 47. Interconnecting link 46 is formed from a flat, metal plate in a punch operation with inwardly turned sides 48, 49 and end 50. Link 46 has a pivotal connection to hinge pin 36 by means of rod 38 which passes through holes 55, 56 in sides 48, 49 of link 46. Link 46 also has a pair of notches 57, 58 formed in sides 48, 49 whose function is later described. Lever 47 has a pivotal connection to link 46 achieved by means of pivot pin 60 which passes through holes 61 (not shown), 62 in sides 48, 49 of link 46 and through aligned holes 65, 66 in sides 67, 68 of lever 47. Pin 60 is suitably secured as by having end 50 of link 46 welded thereto.

Figure 2:
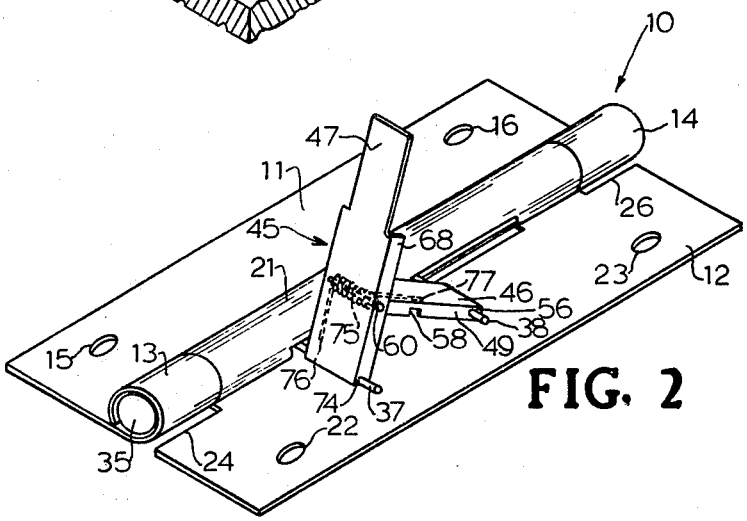
FIG. 2 is a perspective view of the hinge with the lever operated pin actuating mechanism in a half-way position just prior to reaching the separable position.

The finger actuating lever member 47 is formed with sidewalls 67, 68 and top wall 69. Sidewalls 67, 68 have a second set of holes 73, 74 through which passes rod 37 of hinge pin 35. As best seen in FIG. 2, lever 47 is thus pivotal about pivot pin 60 and through such arrangement has a pivotal connection to hinge pin 35.

Figure 6:
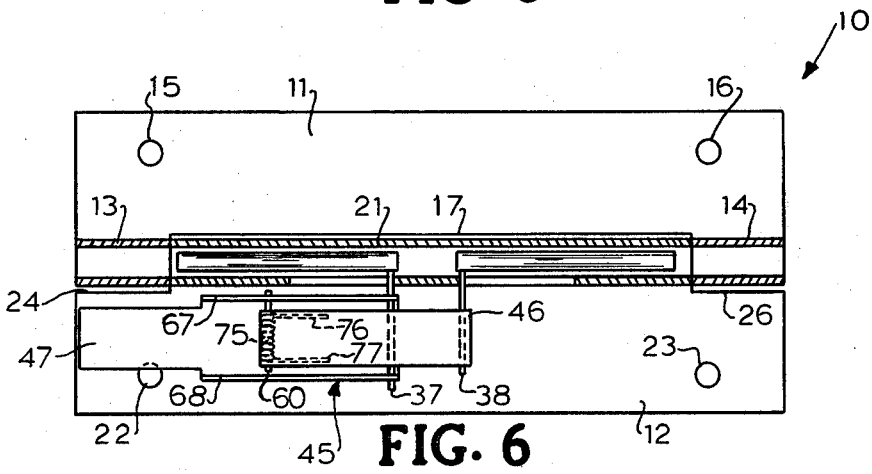
FIG. 6 is a plan view of the hinge with parts of the tubular portions broken away showing the pins in a retracted relationship.
Figure 7:
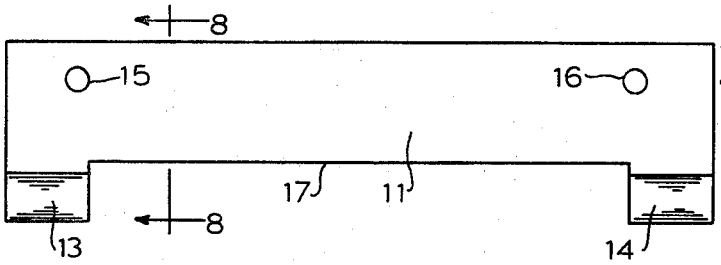
FIG. 7 is a plan view of a first hinge plate.
Figure 8:
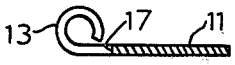
FIG. 8 is a section view taken substantially along line 8—8 of FIG. 7.
Figure 9:
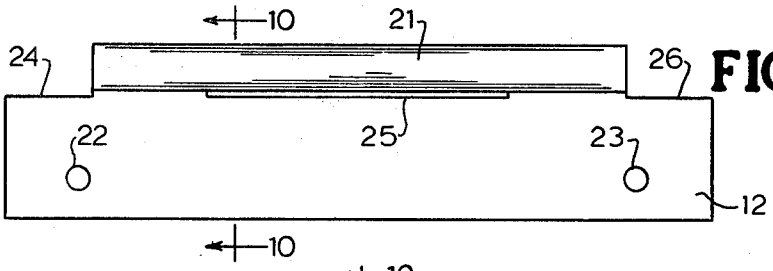
FIG. 9 is a plan view of the second hinge plate.
Figure 10:
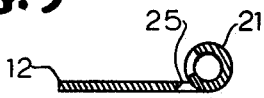
FIG. 10 is a section view taken substantially along line 10—10 of FIG. 9.

As finger activating lever 47 is raised and pivots about pin 60, it will be seen that the interconnecting actuating link member 46 is pulled upward and moves with and in the same direction as that of lever 47 which, in turn, causes hinge pin 36 through the connection provided by rod 38 to be moved inwardly within tubular portion 21. Once lever 47 reaches approximately the position shown in FIG. 2, rod 38 will come into contact with divider 29 and its travel will be stopped. At this point, as lever 47 is continued to be moved in a counterclockwise direction as referred to FIG. 2, and continues to pivot about pin 60, rod 37 will be moved inwardly which, in turn, causes pin 35 to move inwardly also. Once member 47 has been moved into the position of FIG. 3, the middle portion of rod 37 will rest in slots 57, 58 of lever 46 and the inner end portion of rod 37 will abut divider 29 of tubular portion 21 as seen in FIG. 6. At this point, hinge pins 35, 36 will be residing at their most inward positions with the inner ends of rods 37, 38 residing against opposite sides of divider 29 of tubular portion 21. Also, pins 35, 36 will have cleared tubular end portions 13, 14 and will reside completely in tubular portion 21. Thus, plates 11, 12 may be separated as shown in FIG. 4.

Figure 3:
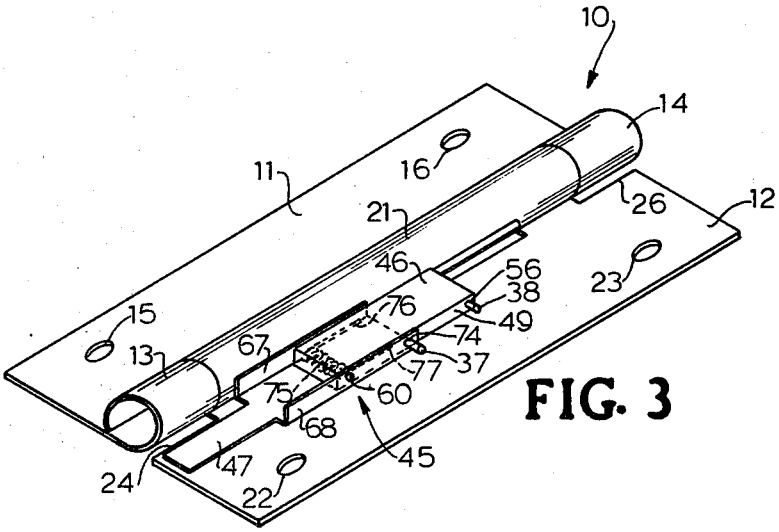
FIG. 3 is a perspective view of the pin actuating mechanism deployed and with the pins retracted.
Figure 4:
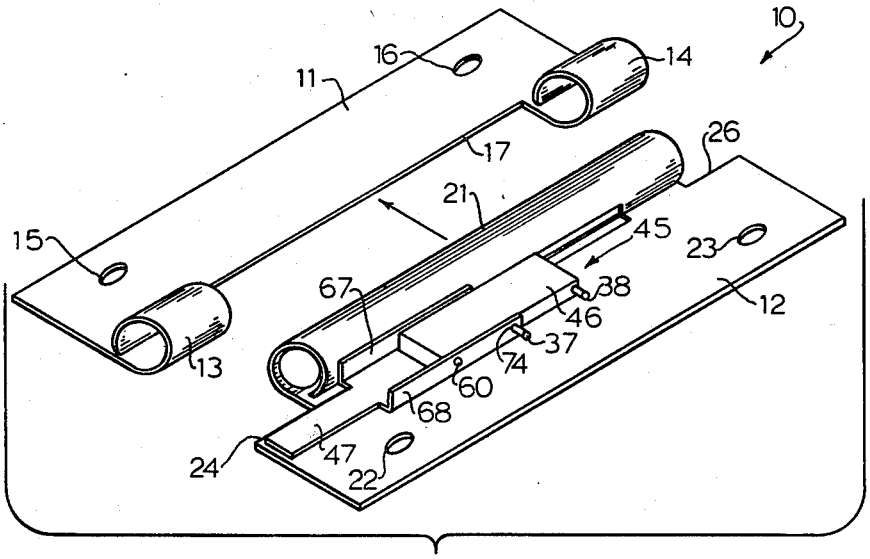
FIG. 4 is a perspective view of the hinge with the hinge plates separated and with the pin actuating mechanism deployed.
Figure 5:
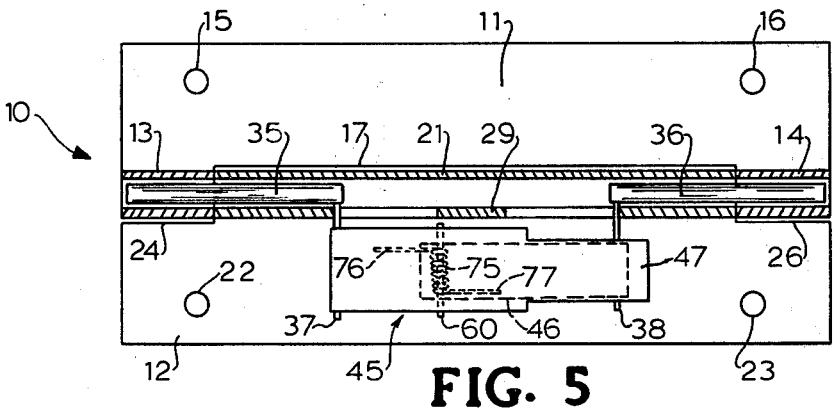
FIG. 5 is a plan view of the hinge with parts of the tubular portions broken away for purposes of illustration and with the pins shown in an extended or locking relationship.
Figure 21:
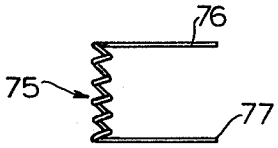
FIG. 21 is a perspective view of a tension spring used with the hinge.

Once tubular portions 13, 14 and tubular portion 21 are realigned, as in FIG. 3, finger activating lever 47 may be moved from the FIG. 3 position to the FIG. 1 position and once again unite hinge plates 11, 12. A spring 75, formed as illustrated in FIG. 21, is mounted on pivot pin 60 and resides beneath the interconnecting actuating link member 46 and within its sides 48, 49. Legs 76, 77 of spring 75 rest against the inside top surface of link 46. Spring 75 tends to maintain members 46, 47 in a fully closed position of FIG. 1 or in an open position as in FIG. 3. Spring 75 also aids in providing a smooth operating separable hinge 10. In operation, separable hinge 10 may be used on any hinged structure in which it is desirable to have means for quickly and easily effecting a separation of the parts without requiring the use of tools, etc., and consumption of time in the separation process.

What is claimed is:

1. A separable hinge, comprising:

(a) a first rectangular hinge plate formed on one side thereof with a central rectangular notch and a pair of aligned hinge pin receiving tubular portions at opposite ends of said plate adjacent said notch;

(b) a second rectangular hinge plate formed on one side thereof with an outwardly extending central hinge pin receiving tubular portion adapted to fit within said first plate notch between said pair of first hinge plate tubular portions to be aligned therewith;

(c) a pair of hinge pins mounted within said second hinge plate tubular portion, said pins being adapted when said first and second plate tubular portions are aligned to be moved outwardly from said second plate tubular portion to enter said first plate tubular portions to effect an assembly of said plates and to be moved inwardly to retract completely within said second plate tubular portion to allow said plates to be disassembled; and (d) an actuating mechanism mounted on said second hinge plate and comprising a pivotal lever and associated linkage connected to said pins at the inner ends thereof and being adapted when said lever is rotated fully in one direction to cause said pins to retract within said second hinge plate tubular portion to allow the assembled plates to be separated and when rotated fully in the opposite direction to allow said plates when said tubular portions are aligned to be assembled by causing said pins to move outwardly from said second hinge plate tubular portion into said first hinge plate tubular portions to effect an assembly of said hinge.

2. A separable hinge as claimed in claim 2 wherein:

(a) said lever comprises a finger-actuated lever having at a base end a pivotal connection extending through a first slot portion formed in one end of said second hinge plate tubular portion and connected to the inner end of one of said pins, said lever being pivotal around an axis extending through said connection and perpendicular to the axis of such pin and said connection being slidable along the length of said slot; and (b) said linkage includes a connecting link member having at a base end a first pivotal connection extending through a second slot portion formed in an opposite end of said second hinge plate tubular portion and connected to the inner end of the other of said pins, said connecting link member having at an outer end a second pivotal connection to an immediate portion of said lever, said connecting link member being pivotal at its said base end around an axis perpendicular to the axis of the pin to which it is connected and said link member first pivotal connection being slidable along the length of said second slot portion.

3. A separable hinge as claimed in claim 2 wherein said connections between said lever and link member base ends and said pins comprise rod members extending laterally from and perpendicular to the axis of said pins and having loose fitting connections to said base ends and wherein said first and second slot portions in said second hinge plate tubular portion are separated by said hinge plate tubular portion wall structure and the ends of said slots are defined by such wall structure such that the limits of travel of said rod portions are regulated by the length of such slot portions.

4. A separable hinge as claimed in claim 3 including spring means mounted on said actuating mechanism and effective to assert a positive force to hold said lever in said respective fully rotated positions when moved thereto.

* * * * *

UNITED STATES PATENT AND TRADEMARK OFFICE

CERTIFICATE OF CORRECTION

PATENT NO. : 4,178,657

DATED : December 18, 1979

INVENTOR(S) : Lee V. Way, Jr.

It is certified that error appears in the above—identified patent and that said Letters Patent is hereby corrected as shown below:

Col. 2, line 32, "place" should be --plate--.

Col. 4, line 24, "in claim 2" should be --in claim 1--.

Signed and Sealed this

*First* Day of *July 1980*

[SEAL]

*Attest:*

SIDNEY A. DIAMOND

*Attesting Officer*

*Commissioner of Patents and Trademarks*